US005727486A

United States Patent [19]

Satoh et al.

[11] Patent Number: 5,727,486

[45] Date of Patent: Mar. 17, 1998

[54] ZIG-ZAG SEWING MACHINE

[75] Inventors: Masahiko Satoh; Seiji Goto, both of Tokyo, Japan

[73] Assignee: Juki Corporation, Tokyo, Japan

[21] Appl. No.: 598,182

[22] Filed: Feb. 7, 1996

[30] Foreign Application Priority Data

Feb. 8, 1995 [JP] Japan ..... 7-020793

[51] Int. Cl.[6] ..... D05B 3/02

[52] U.S. Cl. ..... 112/459

[58] Field of Search ..... 112/220, 221, 112/157, 443, 448, 459, 460, 463, 465

[56] References Cited

U.S. PATENT DOCUMENTS

| | | | |
|---|---|---|---|
| 3,444,832 | 5/1969 | Gray . | |
| 3,670,676 | 6/1972 | Sawada | 112/448 |
| 4,085,690 | 4/1978 | Papajewski | 112/459 |
| 5,267,521 | 12/1993 | Chen | 112/459 |
| 5,601,042 | 2/1997 | Goto | 112/448 X |

FOREIGN PATENT DOCUMENTS

| | | |
|---|---|---|
| 62-10674 | 3/1987 | Japan . |
| 64-70096 | 3/1989 | Japan . |
| 1-42229 | 9/1989 | Japan . |
| 1-42230 | 9/1989 | Japan . |
| 3-99690 | 4/1991 | Japan . |
| 4-79981 | 3/1992 | Japan . |

*Primary Examiner*—Paul C. Lewis
*Attorney, Agent, or Firm*—Morgan, Lewis & Bockius LLP

[57] ABSTRACT

A zig-zag sewing machine includes a needle swinging cam provided on a cam shaft to which the rotational movement of a drive shaft is to be transmitted, and a needle bar support member provided on a slide shaft to which a swinging motion due to its engagement with the needle swinging cam is to be transmitted, while the needle swinging cam includes a cam groove and a positioning hole respectively formed in the side surface thereof. Also, on the side surface of a cam receive member provided on a cam shaft for fixing the needle swinging cam, there is provided a positioning pin which can be fitted into the positioning hole. Further, on the side surface of a cam arm which generates a swinging motion to be transmitted to the slide shaft, there is provided an engaging pin which can be engaged into the cam groove. And, with regard to the lengths of the projecting end portion of the cam shaft, positioning pin and engaging pin, the cam shaft projecting end portion is set the longest, the engaging pin is set the second longest, and the positioning pin is set the shortest.

8 Claims, 7 Drawing Sheets

ZIG-ZAG SEWING MACHINE

BACKGROUND OF THE INVENTION

The present invention relates to a zig-zag sewing machine.

Conventionally, as a zig-zag sewing machine of a cam replacement type which swings a needle bar with a needle to form zig-zag stitches and also in which a needle swinging cam for swinging the needle can be replaced, there is known a zig-zag sewing machine which is disclosed in Japanese Patent Publication No. Sho. 62-10674. In the disclosed sewing machine, the needle swinging cam comprises a composite cam including a pair of outer peripheral cam surfaces and is fixed to a cam shaft which is deceleratingly rotated by a worm fixed to the main shaft of the sewing machine and a worm wheel in mesh with the worm.

And, in the disclosed machine, there is also provided a bell crank lever including in the two end portions thereof two rollers which can be engaged respectively with the two outer peripheral cam surfaces of the composite cam and, if the bell crank lever is rocked with the rotation of the composite cam, then the rocking motion of the bell crank lever is transmitted through a connecting mechanism to a needle support member which is used to support the needle bar, thereby swinging the needle to form zig-zag stitches.

In the zig-zag sewing machine including the mechanism which is disclosed in the above-mentioned Japanese Patent Publication No. Sho. 62-10674, to replace the present composite cam and mount another one, as shown in FIG. 7, there is formed a cut line 106 in the side surface of a composite cam 101. That is, the position of the composite cam 101 is adjusted in the direction of rotation thereof so that the cut line 106 is situated on a radial line 105 connecting a cam shaft 102 with the center of rotation of one roller 104 of a bell crank lever 103, before the composite cam 101 is fixed to the cam shaft 102.

As described above, conventionally, since the composite cam is positioned by use of the cut line, the phase of the composite cam is shifted with respect to the arm shaft and, therefore, after replacement of the cam, the shifted phase must be adjusted or corrected by adjusting the intermeshing between the worm and worm wheel.

This raises a problem that it takes time to adjust the phase of the composite cam to that of the arm shaft after replacement of the cam.

Accordingly, it is an object of the invention to provide a zig-zag sewing machine of a cam replacement type in which a needle swinging cam can be replaced easily together with the adjustment of the phase thereof.

In attaining the above object, according to the invention, there is provided a zig-zag sewing machine comprising: a sewing machine head including a bed portion, an arm portion and a vertical barrel portion; an arm shaft supported in the arm portion of the sewing machine head; a lower shaft supported in the bed portion of the sewing machine head; a cam shaft to which the rotational movement of a drive shaft of the sewing machine is to be transmitted; a needle swinging mechanism including a needle swinging cam fixed on one end of the cam shaft and having a cam portion for controlling a needle swinging motion, the needle swinging mechanism for applying a needle swinging motion to a needle bar in accordance with the movement of an engaging portion engageable with the cam portion of the needle swinging cam; a cam receive member fixed to the cam shaft, the cam receiving member facing to the inside surface of the needle swinging cam; and positioning means for positioning the phase of the needle swinging cam with respect to the drive shaft, the positioning means including, a positioning pin provided on and projecting from one of the opposed surfaces of the cam receive member and the needle swinging cam, and a positioning hole formed in the other opposed surface into which the positioning pin is fitted, wherein one end of the cam shaft is formed as a free end, the cam portion of the needle swinging cam includes a cam groove formed in the opposed surface, the engaging portion includes an engaging pin fittable into the cam groove from the cam receive member side, and the lengths of the engaging and positioning pins are set shorter than the length from the opposed surface of the cam receive member to the free end of the cam shaft.

According to the invention, there is provided a zig-zag sewing machine of a cam replacement type in which, as positioning means for positioning a needle swinging cam, there is provided in the side surface of a cam receive member a positioning pin fittable into a positioning hole formed in the side surface of the needle swinging cam, or, there is provided in the side surface of the needle swinging cam a positioning pin fittable into a positioning hole formed in the side surface of the cam receive member, there is provided in the side surface of a cam arm an engaging pin engageable into a cam groove formed in the side surface of the needle swinging cam, and, with regard to the lengths of the cam shaft, positioning pin and engaging pin from the side surface of the cam receive member, the projecting end portion of the cam receive member is set the longest while one of the positioning pin and engaging pin is set the shortest. Due to this structure, when needle swinging cams are exchanged, the needle swinging cam can be mounted onto the cam receive member easily while adjusting the former in phase to the latter.

In other words, for example, when the positioning pin is set the shortest, at first, the longest cam shaft projecting end portion is inserted into a shaft hole formed in the center portion of the needle swinging cam and the second longest engaging pin is inserted into the cam groove of the needle swinging cam: and, in this state, if the needle swinging cam is rotated on the cam shaft, then the shortest positioning pin can be matched to the position of the positioning hole of the needle swinging cam or cam receive member and finally the positioning pin can be inserted into the positioning hole.

On the other hand, for example, when the engaging pin is set the shortest, the position of the positioning pin is previously designed in such a manner that, with the positioning pin inserted in the positioning hole, the engaging pin can be engaged into the cam groove. After then, if the longest cam shaft projecting end portion is firstly inserted into the shaft hole formed in the central portion of the needle swinging cam and the second longest positioning pin is next inserted into the positioning hole formed in the needle swinging cam or in the cam receive member, then the shortest engaging pin can be finally inserted into the cam groove formed in the needle swinging cam.

DETAILED DESCRIPTION OF THE PREFERRED EMBODIMENTS

Figure 1:
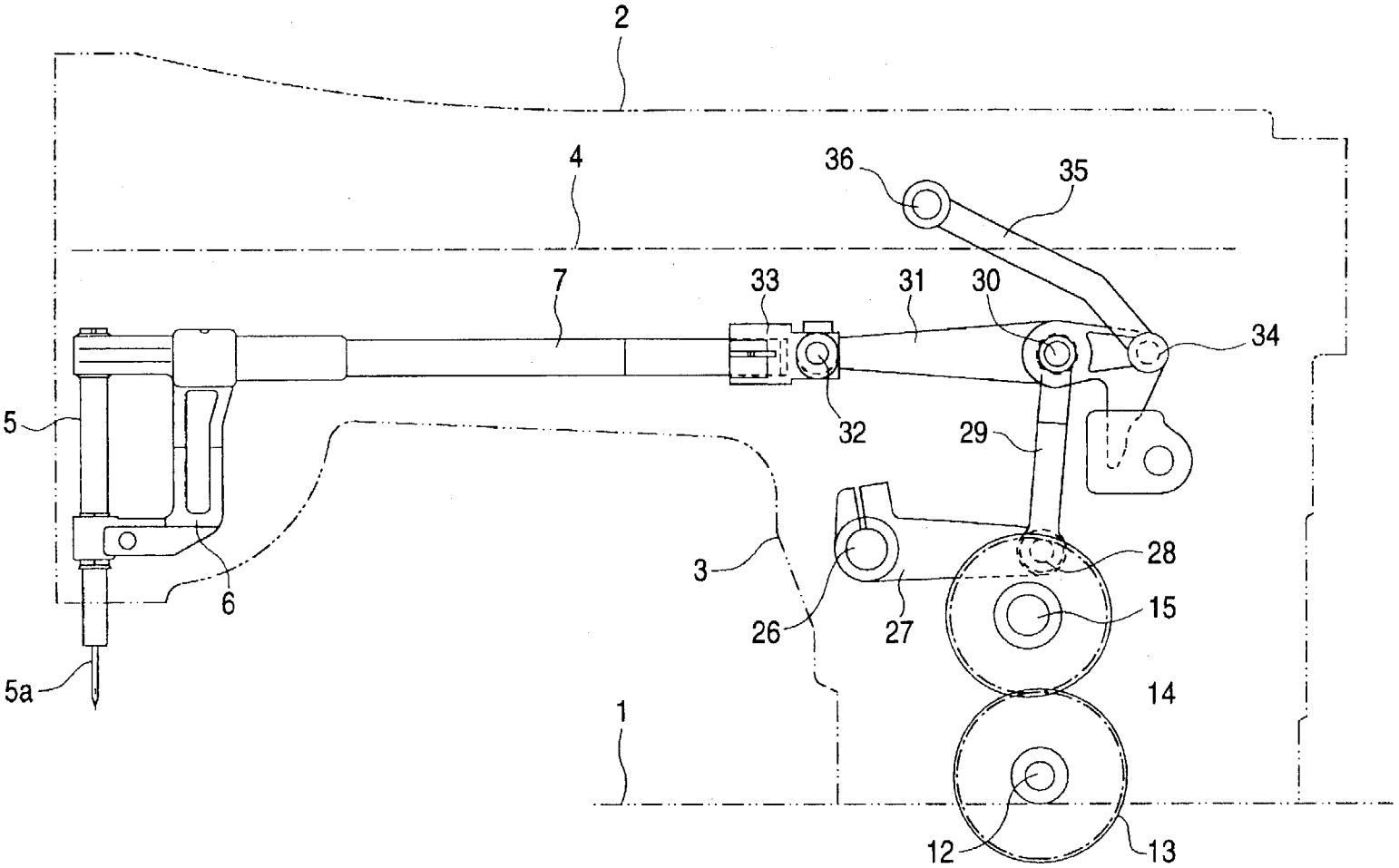
FIG. 1 is a perspective side view of the main portions of a needle swinging mechanism of a first embodiment of a zig-zag sewing machine according to the invention, with the outer contour line of the sewing machine arm portion as an imaginary line.
Figure 2:
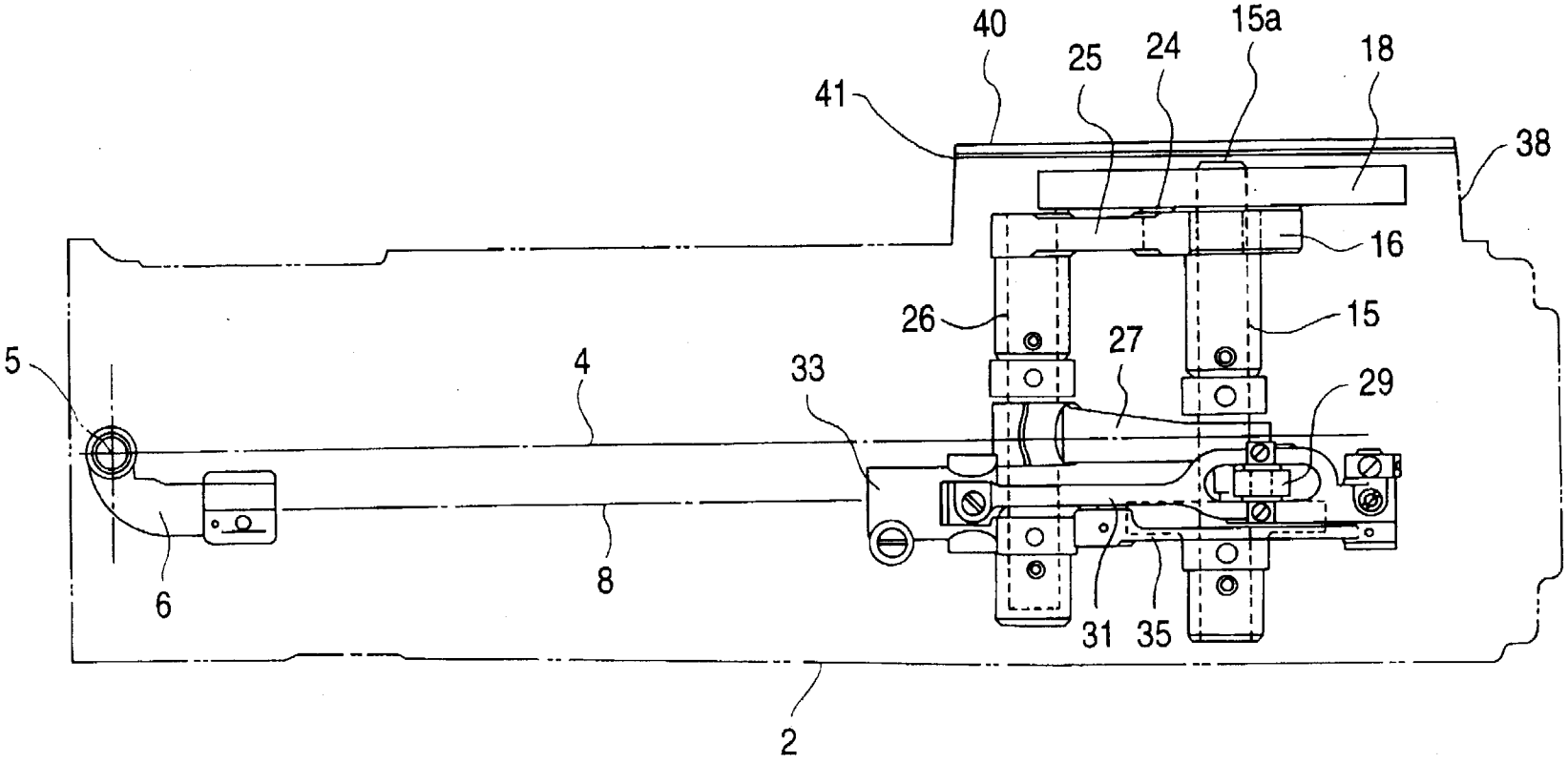
FIG. 2 is a plan view of the main portions of the sewing machine arm portion shown in FIG. 1, when it is viewed from above.

Now, description will be given below in detail of the preferred embodiments of a zig-zag sewing machine of a cam replacement type according to the invention with reference to FIGS. 1 to 6.

According to a first embodiment of the invention, a zig-zag sewing machine comprises a sewing machine head part which includes a bed portion 1, an arm portion 2 and a vertical barrel portion 3. In the interior of the arm portion 2 situated above the vertical barrel portion 3 of the sewing machine head part, there are provided an arm shaft (which is shown as an arm shaft core 4) to be rotated by a sewing machine motor (not shown) through connecting means such as a timing belt or the like, a needle bar 5 to the lower end of which a needle 5*a* is fixed and also which can be moved up and down by a vertically moving mechanism (not shown) in linking with the upper shaft, a needle bar support member 6 for supporting the needle bar 5 in such a manner that the needle bar 5 can be moved up and down, a slide shaft 7 which holds the needle bar support member 6 in the leading end portion thereof and is disposed substantially parallel to the arm shaft, and the like. Also, although not shown, there is provided a needle bar vertically moving mechanism such as a crank mechanism or the like which is used to move the needle bar 5 in the vertical direction in linking with the arm shaft. Further, the needle bar 5 is positioned in such a manner that it can be moved in the axial direction of the upper shaft to thereby perform a needle swinging movement. Below the bed portion 1, there is disposed a lower shaft 9 which is used to drive a loop taker and a cloth feed mechanism (not shown); and, the lower shaft 9 serves as a drive source which applies a needle swinging movement to the slide shaft 7.

Although not shown, as known well, the lower shaft 9 is driven synchronously and rotationally by the upper shaft through a timing belt, a crank rod or the like.

A worm 10 is fixed to the leading end of the lower shaft 9 and a worm wheel 11 fixed to a middle shaft 12 meshes with the leading end of the worm 10. The middle shaft 12 is supported by a sewing machine frame in a direction intersecting the axial direction of the lower shaft 9. Above the middle shaft 12, a cam shaft 15 is arranged almost parallel to the middle shaft 12 and is fixed to the sewing machine frame and a cam shaft gear 14, which is fixed to one end of the cam shaft 15, meshes with a middle shaft gear 13 from the top, while the middle shaft gear 13 is fixed to the middle shaft 12. A cam receive member 16 is fixed to the other end of the cam shaft 15 and a needle swinging cam 18 is fixed to the cam receive member 16. In the needle swinging cam 18, there are formed a hole 19 into which the cam shaft is fitted, and a positioning hole 21 into which a positioning pin 17 projecting out from the cam receive member 16 is fitted, while the positioning hole 21 serves as a reference hole. Further, in the side surface of the needle swinging cam 18 on the cam receive member 16 side, there is formed a cam groove 20.

A needle swinging drive shaft 26 is arranged parallel to the cam shaft 15 and is fixed to the sewing machine frame. A cam arm 25 is fixed to one end of the needle swinging drive shaft 26. A cam engaging pin 23 is supported on the leading end of the cam arm 25. A cam roller 24, which can be fitted into the cam groove 20 in the needle swinging cam 18, is supported by the cam engaging pin 23. Therefore, the needle swinging drive shaft 26 is allowed to swing about its own axis through the cam arm 25 in accordance with the motion of the cam roller 24 which is shifted according to the cam groove 20 of the needle swinging cam 18. A needle swinging drive arm 27 is fixed to the other end of the needle swinging drive shaft 26, while the lower end of a needle swinging drive rod 29 is connected to the leading end of the needle swinging drive arm 27 through a connecting pin 28.

A slide shaft drive member 31 is connected to the upper end of the needle swinging drive rod 29 through a connecting pin 30, while the slide shaft 7 is connected to the leading end of the drive member 31 through a connecting. pin 32 and a connecting member 33. The lower end of an adjusting arm 35 is connected to the rear end portion of the slide shaft drive member 31 through a connecting pin 34, while the upper end of the adjusting arm 35 is supported by an adjusting shaft 36 fixed to the sewing machine frame.

In other words, the worm wheel 11, middle shaft 12, middle shaft gear 13, cam shaft gear 14, cam shaft 15, cam receive member 16, needle swinging cam 18, cam arm 25, needle swinging drive shaft 26, needle swinging drive arm 27, and needle swinging drive rod 29 are disposed in the sewing machine vertical barrel portion 3 and, above them, the slide shaft drive member 31, connecting member 33, adjusting arm 35, and adjusting shaft 36 are located.

And, the worm wheel 11, middle shaft 12, middle shaft gear 13, cam shaft gear 14, cam shaft 15, needle swinging drive shaft 26, needle swinging drive arm 27, and needle swinging drive rod 29 are stored within the vertical barrel portion 3, while the slide shaft drive member 31, connecting member 33, adjusting arm 35, and adjusting shaft 36 are stored within the arm portion 2 located upwardly of the vertical barrel portion 3.

Figure 3:
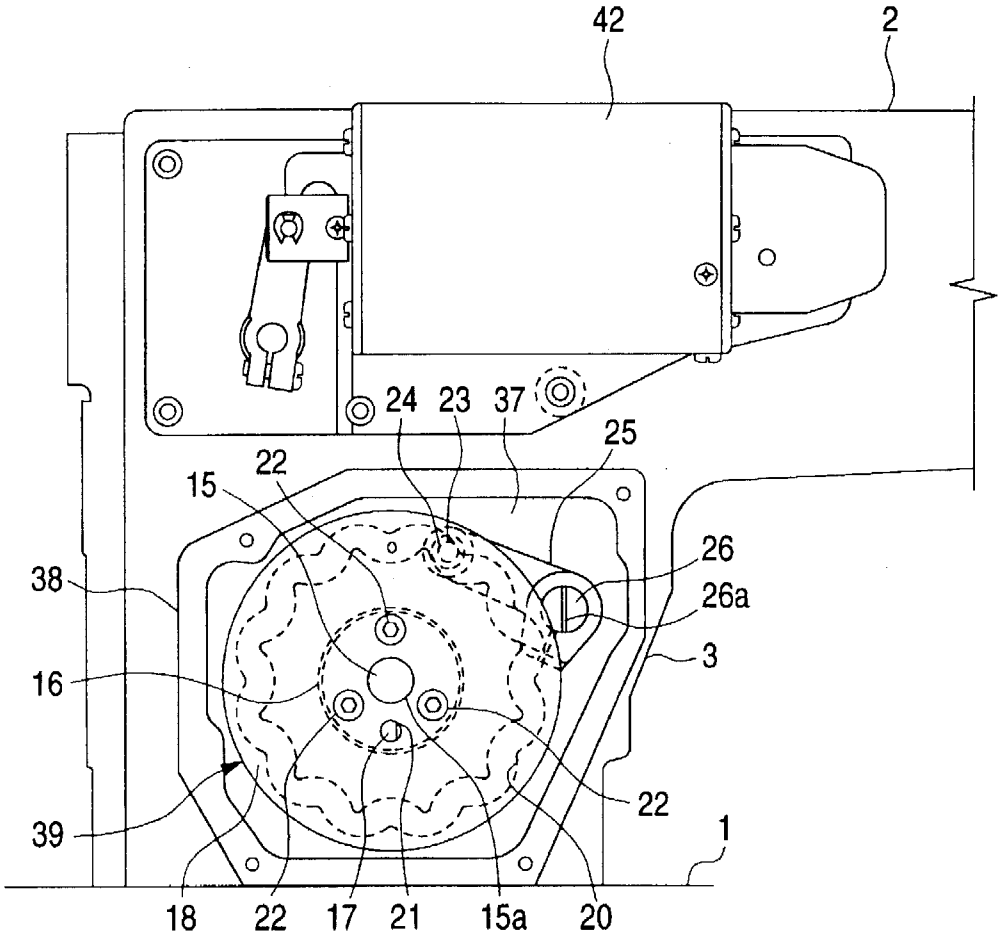
FIG. 3 is a side view of a vertical barrel portion of the sewing machine, when it is viewed from the opposite surface side.
Figure 4:
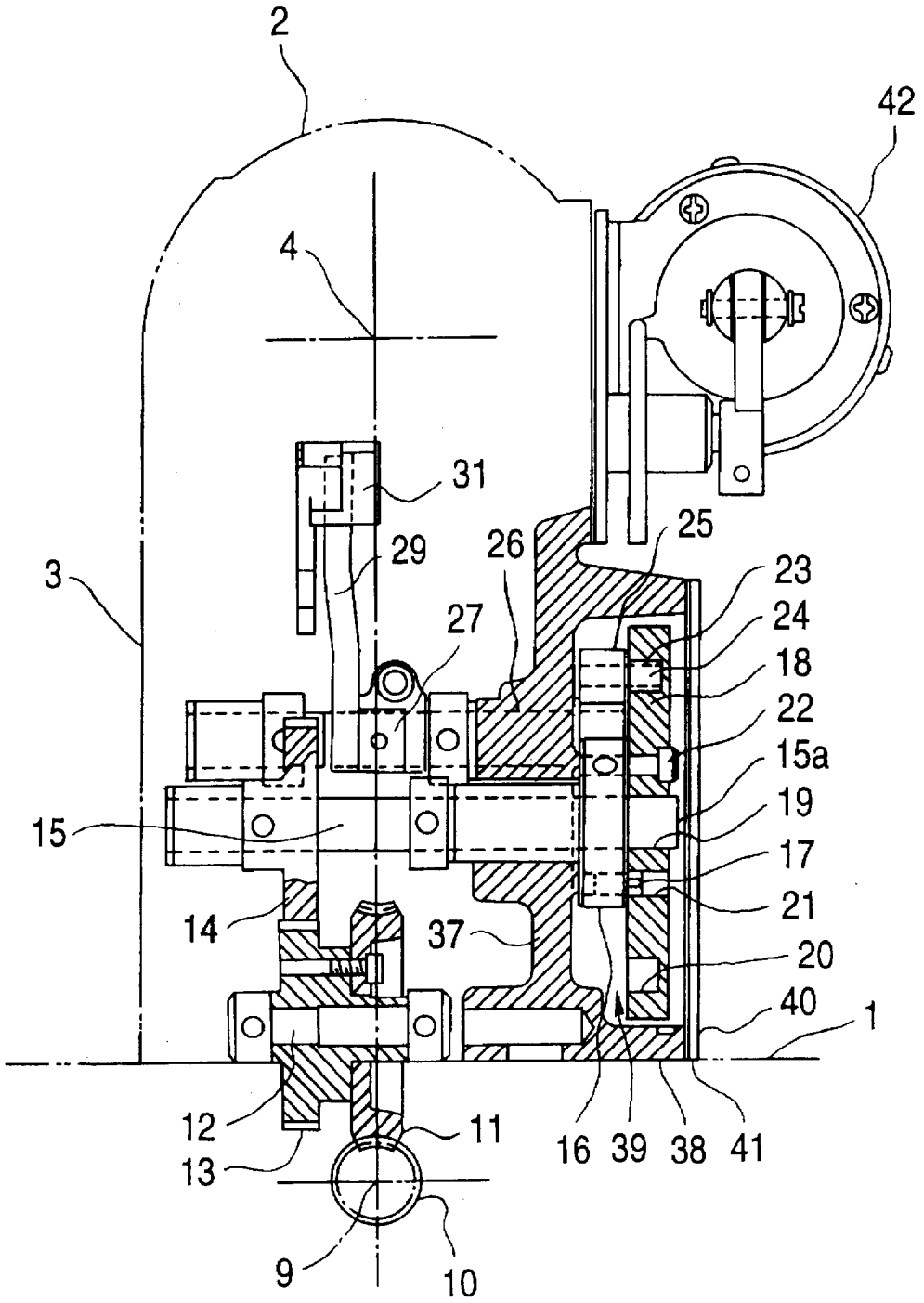
FIG. 4 is a longitudinal section view of the main structure of the vertical barrel portion, when it is viewed from the right.
Figure 5:
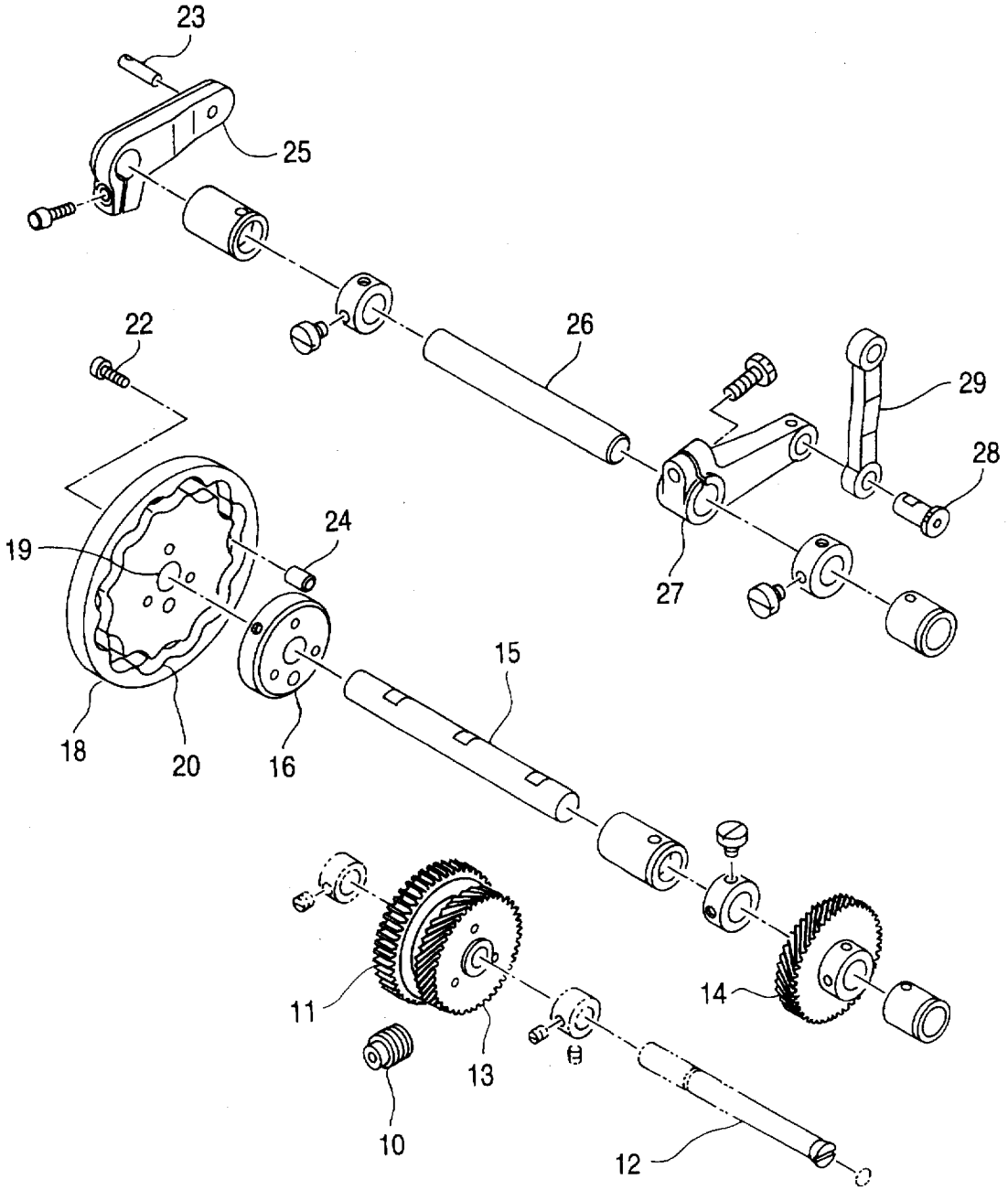
FIG. 5 is an exploded perspective view of components employed in the needle swinging mechanism.

Also, as shown in FIGS. 3 and 4, the cam receive member 16, needle swinging cam 18, and cam arm 25 are separated from the interior of the vertical barrel portion 3 by a partition wall 37 provided on the side surface of the vertical barrel portion 3 and are stored within a cam chamber 39 the periphery of which is enclosed by a peripheral wall 38, while a cover 40 for sealing is mounted through a packing 41 on the outer opening of the side surface of the cam chamber 39.

Further, above the vertical barrel portion 3, a cloth push-up solenoid 42 is mounted on the side surface of the arm portion 2 on the cam chamber 39 side.

Referring further to the above-mentioned needle swinging mechanism, the middle shaft 12 is bearing supported in the lowest portion of the vertical barrel portion 3 adjacent to the bed portion 1.

And, the cam shaft 15 is bearing supported in the middle portion of the vertical barrel portion 3 slightly to the lower portion thereof.

The cam shaft 15 projects out externally from the partition wall 37 of the side surface of the vertical barrel portion 3, with one end portion of the cam shaft 15 extending into the cam chamber 39 enclosed by the peripheral wall 38, while the cam receive member 16 is fixed on this end portion.

The positioning pin 17 includes a chamfered portion in the outer peripheral portion thereof so that it can have guide functions to facilitate the insertion of the needle swinging cam 18 into the positioning hole 21.

To mount the needle swinging cam 18, after a cam shaft portion 15*a* of the cam shaft 15 is inserted into the hole 19 from the side surface of the cam receive member 16 and the positioning pin 17 is fitted into the positioning hole 21 forming the positioning means. Three set screws 22, 22, 22 are respectively screwed through the needle swinging cam 18 into the cam receive member 16, then the cam 18 can be fixed to the cam receive member 16.

Here, referring further to the mounting of the needle swinging cam 18 onto the cam receive member 16, the cam shaft projecting end portion 15*a*, positioning pin 17 leading end and engaging pin 23 leading end are respectively set different in length when they are measured from the side surface of the cam receive member 16.

That is, the length from the cam receive member 16 to the projecting end portion 15*a* is set as the length obtained when the projecting end portion 15*a* extends through and projects out from the hole 19 of the needle swinging cam 18. The length from the cam receive member 16 to the engaging pin 23 leading end is set shorter than the length to the projecting end portion 15*a*. The length from the cam receive member 16 to the positioning pin 17 leading end is set shorter than the length to the engaging pin 23 leading end.

Therefore, to mount the needle swinging cam 18 onto the cam receive member 16, at first, (1) the cam shaft projecting end portion 15*a* is inserted into the shaft hole 19 formed in the central portion of the needle swinging cam 18, next, (2) the engaging pin 23 of the cam arm 25, together with the cam roller 24, is engaged into the cam groove 20 formed in the side surface of the needle swinging cam 18, and, finally, (3) the needle swinging cam 18 is properly rotated on the cam shaft projecting end portion 15*a* and the positioning pin 17 is inserted into the positioning hole 21 formed in the side surface of the needle swinging cam 18.

After then, the three set screws 22, 22, 22 are respectively screwed through the needle swinging cam 18 into the cam receive member 16 to thereby fix the needle swinging cam 18 to the cam receive member 16.

And, as shown in FIG. 3, the needle swinging drive shaft 26 is bearing supported laterally of the needle swinging cam 18 in the vertical barrel portion 3 and includes, in the end face thereof projecting into the cam chamber 39, a slot 26*a* which is used to adjust the cam roller 24 to the cam groove 20. Further, the needle swinging drive arm 27 is fixed to the portion of the drive shaft 26 that extends into the vertical barrel portion 3.

The needle swinging drive rod 29 extends upwardly and, to the upper end portion of the drive rod 29, there is connected a slide shaft drive member 31 through the connecting pin 30 in such a manner that they are free to swing with respect to each other.

The slide shaft drive member 31 extends horizontally with one end portion thereof connected through the connecting pin 32 to the connecting member 33, while the slide shaft 7 is fixedly connected to the connecting member 33.

Also, to the other end portion of the slide shaft drive member 31 on the connecting side thereof where the needle swinging drive rod 29 is connected to the connecting pin 30, there is connected the adjusting arm 35 through the connecting pin 34 in such a manner that they are free to swing with respect to each other.

The adjusting arm 35 has a leading end portion which exists in the arm portion 2 and is supported such that it is freely swingable through the adjusting shaft 36. By changing the position of the adjusting shaft 36, the amount of sliding of the slide shaft 7 due to the swinging motion of the slide shaft drive member 31 can be adjusted.

In the above-mentioned needle swinging mechanism of the zig-zag sewing machine using the drive shaft as the lower shaft, the rotation of the worm 10 to be rotated integrally with the lower shaft 9 is converted into the decelerating rotation of the worm wheel 11, and the decelerating rotation of the worm wheel 11 is then transmitted to the cam shaft 15 through the cam shaft gear 14 in mesh with the middle shaft gear 13 which is disposed in parallel to the worm wheel 11 and is arranged integrally with the middle shaft 12.

And, due to the rotation of the needle swinging cam 18 arranged integrally with the rotating cam shaft 15, the cam arm 25 including the engaging pin 23 in engagement with the cam groove 20 is caused to swing along the shape of the cam groove 20 integrally with the needle swinging drive shaft 26.

Here, since the needle swinging drive shaft 26 also includes the needle swinging drive arm 27 formed integral therewith, the needle swinging drive arm 27 also swings integrally with the needle swinging drive shaft 26 and the swinging motion of the drive arm 27 is converted through the connecting pin 28 into a synthesized swinging motion involving the vertical motion of the needle swinging drive rod 29.

Further, the synthesized swinging motion involving the vertical motion of the swinging drive rod 29 is then transmitted through the connecting pin 30 to the slide shaft drive member 31, so that the slide shaft drive member 31 is caused to carry out a swinging motion with the connecting pin 32 connecting the drive member 31 to the connecting member 33 as a fulcrum and, at the same time, the slide shaft drive member 31, in accordance with a swinging motion with the adjusting shaft 36 of the adjusting arm 35 connected through the connecting pin 34 to the other end of the drive member 31 as a fulcrum, causes the slide shaft 7 to perform a reciprocating motion along the axial direction thereof through the connecting member 33.

As a result of this, the needle bar support member 6 included in the slide shaft 7 is caused to execute a reciprocating motion in the horizontal direction integrally with the slide shaft 7. As known well, the needle bar is caused to carry out a reciprocating motion in the vertical direction through a crank mechanism or the like by the upper shaft. That is, the horizontally reciprocating motion of the needle bar support member 6 is synthesized with the vertically reciprocating motion of the needle bar to thereby be able to achieve desired zig-zag stitches.

As described above, in a zig-zag sewing machine, according to the present embodiment, since there is structured a needle swinging mechanism in which the middle shaft 12 is interposed between the lower shaft 9 and cam shaft 15, when compared with the conventional mechanism in which the rotation of the upper shaft used as the drive shaft is transmitted directly to the cam shaft, the position of the cam shaft 15 can be set freely with respect to the drive shaft, that is, as in the present embodiment, the cam shaft 15 can be disposed in the vertical barrel portion 3.

For this reason, the position of the needle swinging cam 18 can be determined in consideration of the incidental equipment, which can contribute to an improvement in productivity.

That is, as in the present embodiment, even if the cloth push-up solenoid 42 is mounted on the side surface of the arm portion 2 located above the vertical barrel portion 3, the needle swinging cam 18 can be disposed in the vertical barrel portion 3 located below the arm portion 2.

Also, according to the present embodiment having the above-mentioned structure, when compared with the conventional zig-zag sewing machine, the position of the needle swinging cam 18 can be lowered.

In this manner, since the needle swinging cam 18 is situated in the barrel portion 3, the position of the needle swinging cam 18 is lower than the surface of the sewing machine bed portion 1, thereby being able to obtain an effect that the degree of vibrations generated can be controlled.

Further, because the cam receive member 16, needle swinging cam 18 and cam arm 25 are independently stored within the cam chamber 39, which is formed in the side surface of the vertical barrel portion 3 but is separated from the interior space of the barrel portion 3 by the partition wall 37 and is enclosed by the peripheral wall 38, and also because the outer opening of the cam chamber 39 is covered with the cover 40 to thereby provide a closed structure, the following effects can be obtained:

(1) Since the needle swinging cam 18 is disposed in the cam chamber 39 separated from the interior space of the arm portion 2, there is eliminated the possibility that lubricating oil can be scattered onto the needle swinging cam 18 from the interior of the arm portion 2, thereby being able to prevent oil from sticking to the surface of the needle swinging cam 18. As a result of this, the needle swinging cam 18 is prevented against slippage when it is replaced and, therefore, a cam replacement operation can be performed safely.

(2) Although the cover 40 of the cam chamber 39 is opened and closed when the needle swinging cam 18 is replaced with a new one, as described above, since no oil can be scattered from the interior of the arm portion 2, it is possible to prevent oil leakage from the cover 40 and packing 41.

(3) As mentioned above, oil is prevented from scattering onto and sticking to the needle swinging cam 18 from the interior of the arm portion 2, with the result that no oil can be scattered out from the needle swinging cam 18. This eliminates the need to provide a special oil discharge structure in the cam chamber 39 and to provide a forced sealing means in the cover 40, which results in the reduced cost and simplified structure of the sewing machine.

(4) The cam chamber 39 is shut off from the interior space of the arm portion 2 (vertical barrel portion 3) by the partition wall 37 and is covered by the cover 40 to thereby provide a closed structure with respect to the outside, and the cam chamber 39 is also enclosed by the partition wall 37 and cover 40 to thereby provide a so called dual wall structure with respect to the interior space of the arm portion 2 (vertical barrel portion 3). This prevents external foreign matters such as cloth dust and the like from invading into the interior space of the arm portion 2, when the needle swinging cam 18 is replaced.

(5) Since the cam chamber 39 is disposed in the vertical barrel portion 3, the maintenance of the cam chamber 39 can be done easily by opening and closing the cover 40 on the side surface of the vertical barrel portion 3, just above the sewing machine bed portion 1.

And, in particular, with regard to the relationship among the lengths of the cam shaft projecting end portion 15*a*, positioning pin 17 and engaging pin 23 respectively measured from the side surface of the cam receive member 16, the length of the cam shaft projecting end portion 15*a* is set the largest, the length of the positioning pin 17 is set the shortest, and the length of the engaging pin 23 of the cam arm 25 is set between the two largest and shortest lengths. Due to this, in the replacement of the needle swinging cam 18, at the same time when the needle swinging cam 18 is mounted onto the cam receive member 16, the phase of the engaging pin 23 with respect to the cam groove 20 (the phase of the cam groove 20 with respect to the arm shaft serving as a main shaft) can be adjusted or corrected easily.

In other words, due to the fact that, with regard to the lengths of the above three-components from the side surface of the cam receive member 16, they are set in the order of the cam shaft projecting end portion 15*a*, engaging pin 23 and positioning pin 17 from the longest, as described above, if (1) the cam shaft projecting end portion 15*a* is inserted into the shaft hole 19 of the needle swinging cam 18, (2) the engaging pin 23 of the cam arm 25 together with the cam roller 24 is engaged into the cam groove 20 of the needle swinging cam 18, and (3) the positioning pin 17 is finally inserted into the positioning hole 21 while rotating the needle swinging cam 18, then simultaneously with the positioning of the needle swinging cam 18 the phase of the engaging pin 23 with respect to the cam groove 20 (the phase of the cam groove 20 with respect to the arm shaft) can also be adjusted.

As described above, in the replacement of the needle swinging cam 18, the needle swinging cam 18 can be easily removed from and mounted onto the cam receive member 16 for a short time, that is, the present structure is advantageous in that, while carrying out the above phase adjusting operation, the needle swinging cam 18 can be easily mounted onto the cam receive member 16 for a short time.

Therefore, in the zig-zag sewing machine of a cam replacement type, the machine stop time necessary for the replacement of the needle swinging cam 18 can be shortened to thereby improve the productivity thereof accordingly.

By the way, referring to the mounting of the needle swinging cam 18 onto the cam receive member 16, in the above-mentioned embodiment, with regard to the lengths measured from the side surface of the cam receive member 16, the lengths are set in the order of the cam shaft projecting end portion 15*a*, engaging pin 23 and positioning pin 17 from the longest. However, this is not limitative but they can be set in the order of the cam shaft projecting end portion 15*a*, positioning pin 17 and engaging pin 23 from the longest.

In this case, the positions of the positioning pin 17 and positioning hole 21 must be previously designed in such a manner that the engaging pin 23 can be matched to the cam groove 20.

The present invention, of course, includes such modification as well.

In this manner, even if, with regard to the lengths measured from the side surface of the cam receive member 16, the lengths are set in the order of the cam shaft projecting end portion 15*a*, positioning pin 17 and engaging pin 23 from the longest, similarly to the above-mentioned embodiment, in the replacement of the needle swinging cam 18, at the same time when the needle swinging cam 18 is mounted onto the cam receive member 16, the phase of the engaging pin 17 with respect to the cam groove 20 (the phase of the cam groove 20 with respect to the arm shaft serving as the main shaft) can also be adjusted easily.

In other words, when, with regard to the lengths from the side surface of the cam receive member 16, the lengths are set in the order of the cam shaft projecting end portion 15*a*, positioning pin 17 and engaging pin 23 from the longest, if (1) the cam shaft projecting end portion 15 is firstly inserted into the shaft hole 19 of the cam swinging cam 18, next (2) the positioning pin 17 is inserted into the positioning hole 21 of the needle swinging cam 18, and finally (3) the engaging pin 23 of the cam arm 25 together with the cam roller 24 is engaged with the cam groove 20 of the needle swinging cam 18, then the phase of the engaging pin 23 with respect to the cam groove 20 (the phase of the cam groove 20 with respect to the arm shaft) can be adjusted simultaneously with the positioning of the needle swinging cam 18.

Therefore, according to the modification, similarly to the previously described embodiment, in the zig-zag sewing machine of a cam replacement type, the machine stop time necessary to replace the needle swinging cam 18 can be reduced to thereby enhance the productivity thereof.

Figure 6:
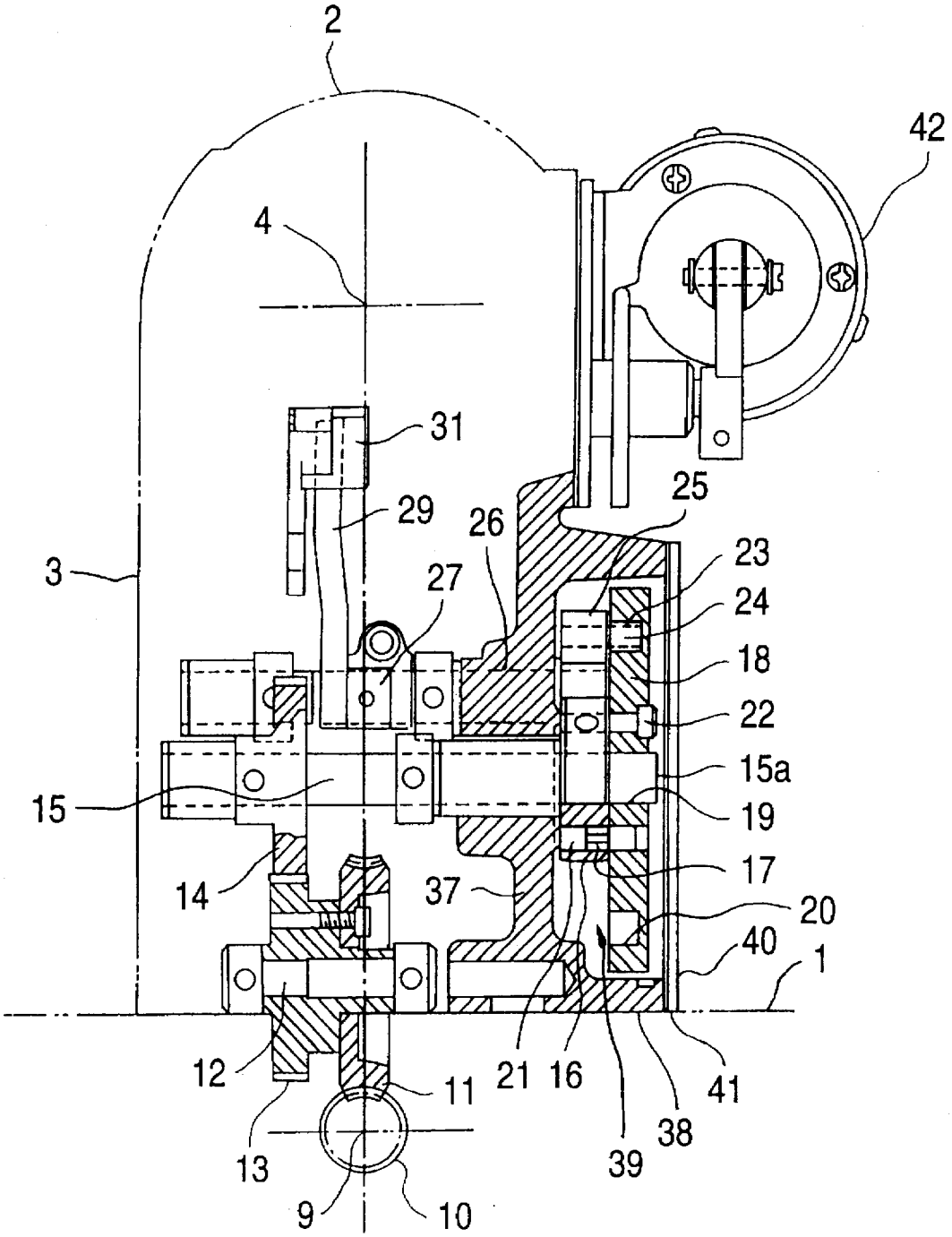
FIG. 6 is a longitudinal section view of a second embodiment according to the invention, similar to FIG. 4.
Figure 7:
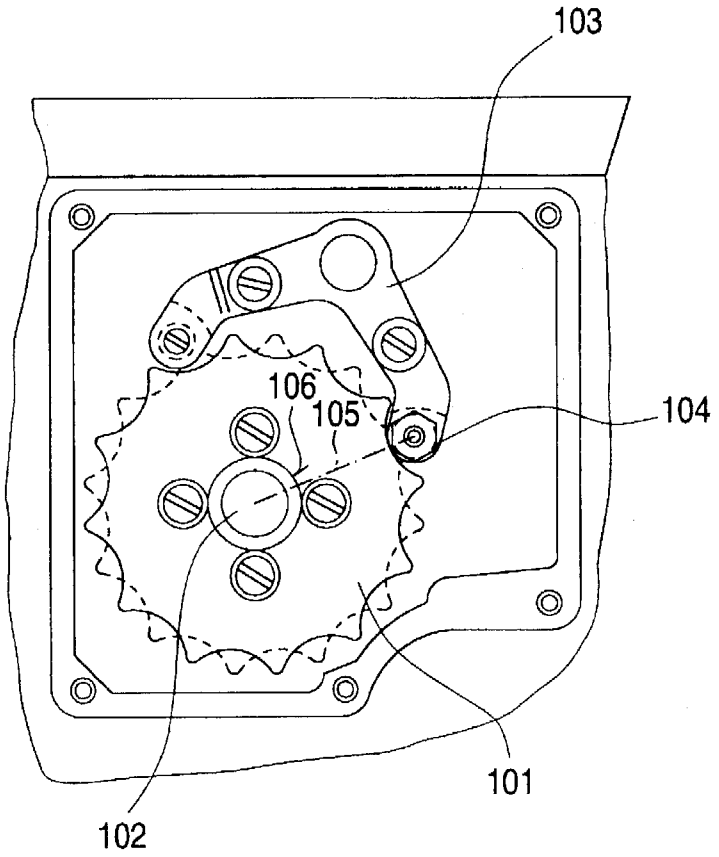
FIG. 7 PRIOR ART
FIG. 7 is a side view of a conventional cam mechanism.

Next, description will be given below of a second embodiment of a zig-zag sewing machine of a cam replacement type according to the invention, which is shown in FIG. 6.

In the above-mentioned first embodiment, the positioning hole 21 is formed in the side surface of the needle swinging cam 18 and the positioning pin 17 is provided on the side surface of the cam-receive member 16. On the other hand, in the second embodiment, with regard to the positioning means for positioning the needle swinging cam 18, as shown in FIG. 6, the positioning pin 17 is provided on the side surface of the needle swinging cam 18 and the positioning hole 21 is formed in the side surface of the cam receive member 16.

As in the above second embodiment, even in the positioning means structured such that the positioning pin 17 to be fitted into the positioning hole 21 formed in the side surface of the cam receive member 16 is provided on the side surface of the needle swinging cam 18, of course, if the relationship among the lengths of the positioning pin 17, cam shaft projecting end portion 15*a* and engaging pin 23 is set similarly to the first embodiment, then a similar effect to the first embodiment can be obtained.

That is, the present invention includes the second embodiment as well.

In the illustrated embodiments, the power transmission from the middle shaft to the cam shaft is carried out by means of the gear mechanism. However, the invention is not limited to this but the power transmission from the middle shaft to the cam shaft can also be executed by use of a timing belt device.

Also, the way of the power transmission from the cam arm to the slide shaft can be selected arbitrarily and, further, the concrete detailed structures of the invention, of course, can also be changed properly according to cases.

As has been described heretofore, in the zig-zag sewing machine according to the invention, due to the fact, especially, with regard to the lengths of the cam shaft projecting end portion, positioning pin and engaging pin from the side surface of the cam receive member, the cam shaft projecting end portion is set the longest and either of the positioning pin or engaging pin is set the shortest, when a new needle swinging cam is mounted after an old one is removed, at first, the longest cam shaft projecting end portion is inserted into the shaft hole formed in the central portion of the needle swinging cam, a longer one of the positioning and engaging pins is next inserted into the positioning hole or into the cam groove formed in the needle swinging cam or in the cam receive member, and a shorter one of the positioning and engaging pins is finally inserted into the positioning hole or into the cam groove formed in the needle swinging cam or in the cam receive member, whereby the phase of the needle swinging cam can be adjusted simultaneously when it is mounted.

Therefore, in the cam replacing operation, the needle swinging cam can be easily mounted onto the cam receive member for a short time while adjusting the phase thereof.

As a result of this, the machine stop time due to the cam replacement can be shortened to thereby enhance the productivity of the present zig-zag sewing machine.

What is claimed is:

1. A zig-zag sewing machine comprising:

a sewing machine head including a bed portion, an arm portion and a vertical barrel portion;

an arm shaft supported in the arm portion of the sewing machine head;

a lower shaft supported in the bed portion of the sewing machine head;

a cam shaft to which the rotational movement of the lower shaft is to be transmitted;

a needle swinging mechanism including a needle swinging cam fixed on one end of the cam shaft and having a cam portion for controlling a needle swinging motion, and an engaging portion engageable with the cam portion for transferring the needle swinging motion to a needle bar;

a cam receiving member fixed to the cam shaft, the cam receiving member having a side surface facing an inside surface of the needle swinging cam; and positioning means for positioning the phase of the needle swinging cam with respect to the cam shaft, the positioning means including, a positioning pin provided on and projecting from one of two opposed surfaces between the side surface of the cam receiving member and the inside surface of the needle swinging cam, and a positioning hole formed in the other of two opposed surfaces into which the positioning pin is fitted, wherein one end of the cam shaft is formed as a free end, the cam portion of the needle swinging cam includes a cam groove formed in the inside surface of the needle swinging cam, the engaging portion includes an engaging pin fittable into the cam groove from the cam receiving member side, and lengths of the engaging and positioning pins are set shorter than a length from the side surface of the cam receiving member to the free end of the cam shaft.

2. A zig-zag sewing machine according to claim 1, wherein the length of the engaging pin is different from that of the positioning pin.

3. A zig-zag sewing machine according to claim 1, wherein the needle swinging cam is supported by the cam shaft interposed in the vertical direction between the lower shaft and the arm shaft; and a needle swinging drive unit is disposed in the vertical direction above the cam shaft, for transmitting the needle swinging motion to the needle bar in accordance with the movement of the cam portion of the needle swinging cam.

4. A zig-zag sewing machine according to claim 3, wherein the cam shaft and the middle shaft are disposed within the vertical barrel portion.

5. A zig-zag sewing machine according to claim 4, wherein the vertical barrel portion includes:

a partition wall to form a chamber for storing the needle swinging cam and the engaging portion therein;

an opening for opening the chamber outwardly; and a cover for covering the opening.

6. A zig-zag sewing machine according to claim 1, further comprising a middle shaft interposed in the vertical direction between the cam shaft and the lower shaft, for transmitting the rotational movement of the lower shaft to the cam shaft.

7. A zig-zag sewing machine according to claim 2, wherein the length of the positioning pin is shorter than the length of the engaging pin.

8. A zig-zag sewing machine according to claim 3, wherein the needle swinging drive unit comprises:

a needle swinging drive shaft having a cam arm engageable with the needle swinging cam; and a needle swinging drive arm attached to the needle swinging drive shaft for transferring the needle swinging motion to the needle bar.

* * * * *